US005411332A

United States Patent [19]

Avery, Jr.

[11] Patent Number: 5,411,332

[45] Date of Patent: May 2, 1995

[54] BLENDER WITH VIRTUAL BAFFLE OF PARTICULATE MATERIAL

[76] Inventor: Hugh E. Avery, Jr., 3764 Lake St., Houston, Tex. 77098

[21] Appl. No.: 858,704

[22] Filed: Mar. 27, 1992

Related U.S. Application Data

[63] Continuation-in-part of Ser. No. 683,320, Apr. 10, 1991, Pat. No. 5,123,749.

[51] Int. Cl.[6] ..... B01F 5/24

[52] U.S. Cl. ..... 366/336; 366/10; 366/101

[58] Field of Search ..... 366/9, 10, 101, 106, 366/107, 136, 137, 177, 336, 341

[56] References Cited

U.S. PATENT DOCUMENTS

| | | | |
|---|---|---|---|
| 2,805,802 | 9/1957 | Strong | 366/177 |
| 3,936,037 | 2/1976 | Leonard | 366/177 |
| 4,353,652 | 10/1982 | Young | 366/341 |
| 4,629,328 | 12/1986 | Revelt | 366/177 |

FOREIGN PATENT DOCUMENTS

| | | | |
|---|---|---|---|
| 1804405 | 5/1970 | Germany | 366/177 |

*Primary Examiner*—David A. Scherbel
*Assistant Examiner*—Terrence R. Till
*Attorney, Agent, or Firm*—Ezra L. Schacht

[57] ABSTRACT

A blending apparatus, inexpensive in construction and requiring a minimum of recirculation, is today essential for economical and thorough blending of particulate material, for example, plastic pellets of virgin material and of pellets that have been reconstituted from recycled material. Construction of the blender is low in cost because the customary receiver, and its piping, conventionally installed below the blender are eliminated. The novel convex baffle serves:(1) as a termination surface for the conventional perforated blending conduits; and (2) retains a toroidal annular volume of particulate material in position between the upper outer surface of the baffle and the inside wall of the blender. The particulate material passes through the blending tubes, drops into the blending area below the convex baffle, whereupon the small amount of particulate material in the toroidal block or "keystone joist" is released to proportionally blend with it.

1 Claim, 9 Drawing Sheets

FIG.3
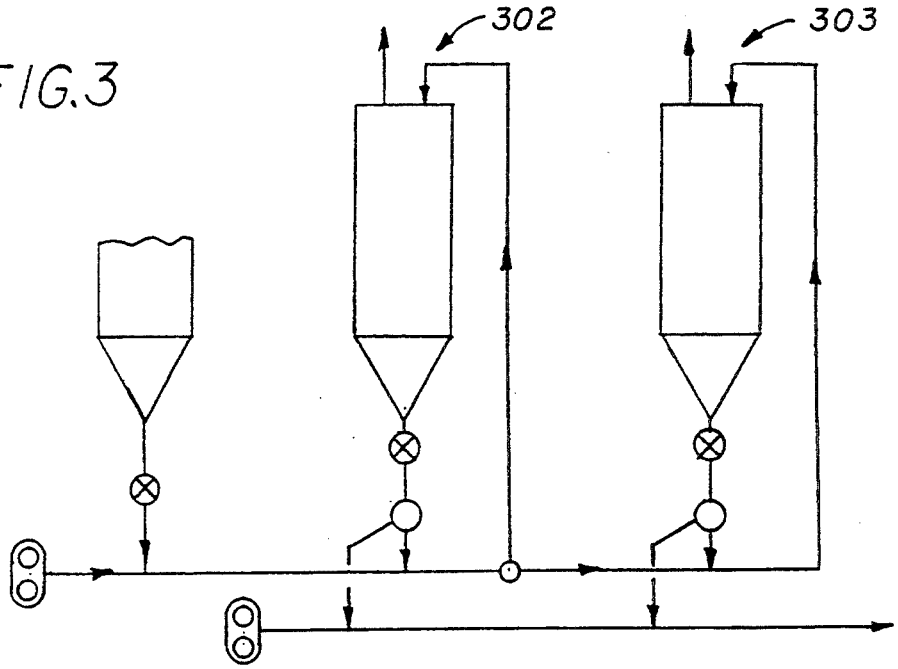
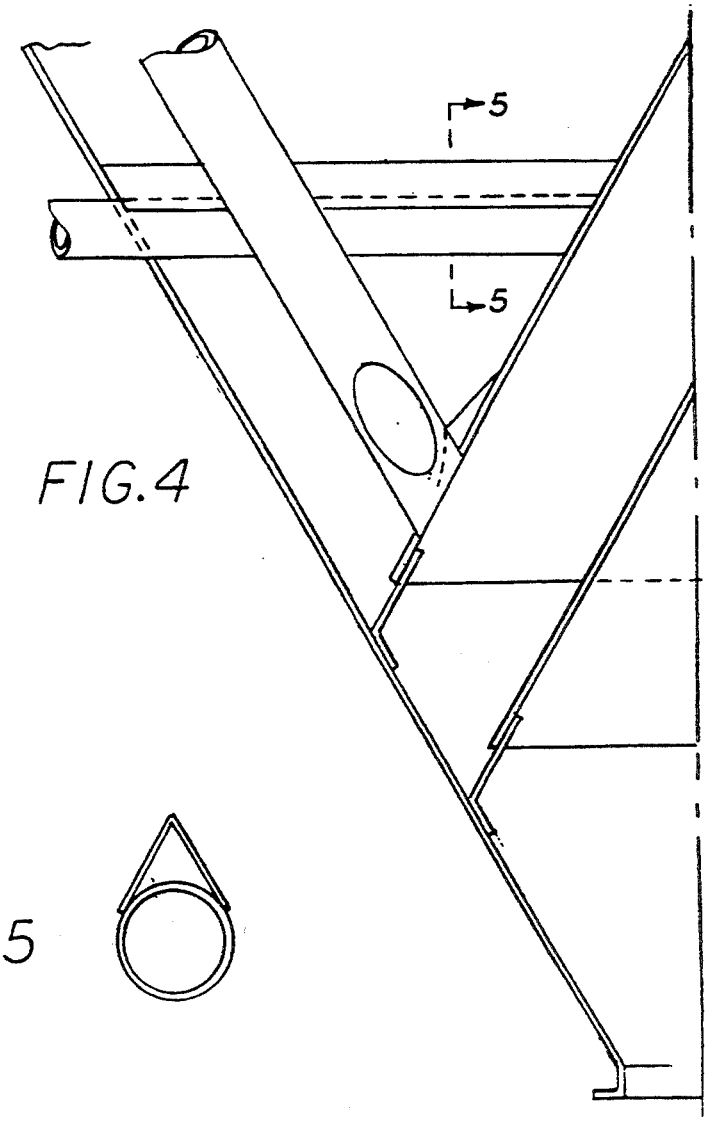
FIG.4
FIG.5

BLENDER WITH VIRTUAL BAFFLE OF PARTICULATE MATERIAL

CROSS REFERENCE TO RELATED APPLICATION

This application is a continuation-in-part of application Ser. No. 07/683,320, now U.S. Pat. No. 5,123,749, filed Apr. 10, 1991.

BACKGROUND OF THE INVENTION

1. Field of the Invention

This invention relates to blenders and more particularly to method and apparatus for thoroughly blending particulate or granular materials with virtually no recirculation required.

2. Description of the Prior Art

As storage bins or hoppers are filled with granular or particulate material, it often happens that an inhomogeneous distribution of material occurs. There may be several reasons for this result. In the first place, as material flows into a hopper, the material beneath the inlet nozzle piles up at the angle of repose of the material. In this case the larger particles often roll down the peak toward the sides of the hopper, leaving the finer particles in the central region. Inhomogeneity can also occur when the hopper is filled with different batches of the same material because of variations of composition of individual batches. When material is drawn off through an outlet at the bottom of the hopper, the material flows from the region directly above the nozzle. Thus the material will not be representative of the average characteristics of the material in the hopper.

Prior art attempts at a solution to this segregation problem typically included placing perforated blending tubes vertically within the hopper. Such tubes have openings spaced apart along their axes which allow material from all levels within the hopper to enter the tubes. The lower portion of the blending tubes communicate with the outlet nozzle so that a more nearly homogeneous mixture of the material issues from the outlet of the hopper.

In spite of many efforts to completely blend the particulate material, it is usually necessary in prior art blenders to specially treat at least the final portion of the discharge to achieve acceptable results. For example, U.S. Pat. No. 4,923,304, discloses that the first and last few pounds are not used, but instead are withdrawn and later remixed with fresh ingredients, ad re-poured, with these fresh ingredients, back into the dispensing apparatus.

SUMMARY OF THE INVENTION

My invention, in the preferred embodiment disclosed herein, in combination with a conventional hopper and conventional blending tubes can effectively blend the final portion of a batch of material. The principle employed is illustrated in the drawings, specifically FIGS. 11-13, and described in detail herein.

In the parent application, the embodiment of FIGS. 2 and 6 is disclosed. In this C.I.P application, my invention shown herein in an alternate embodiment, deals with the problem in a less costly fashion.

In FIG. 2, and as more easily seen in FIG. 6, the blending tubes, of which tube 602 is an example, terminate in apertures 603. These apertures are formed in the convex surface 604. This means of termination is a significant departure from the prior art, as shown in FIG. 1, in which tubes 24 pass entirely through the hopper 10 and terminate in receiver 28.

Returning to FIG. 6, it should be noted that convex surface 604 is supported upon brackets 606, and is thus spaced away from the exterior cone 610 by an annular gap shown as 605. Now, if the surfaces 604, annular gaps 605, and apertures 603, are designed as will be shown in connection with the description of FIG. 9, the material to be blended will begin to fill the hopper 601, but will form a barrier at the annulus 605, past which barrier the particulate material will not descend.

As the blending operation being performed on the batch, or mixture, draws to a close, the level of the material will fall below the seam line 607, and then past a series of apertures 608. The discharge of material from the blender will then flow preferentially from the blending tubes 602, with essentially zero flow through the annulus 605 between the inverted cone and the vessel cone. Flow through this annulus 605 cannot occur until the supply of material coming from the blend tubes 602 is exhausted.

In the embodiment disclosed herein, the blender uses a number of blending tubes or channels which terminate at the same elevation adjacent to a small inverted cone 1113 as shown in FIG. 11, or without an inverted cone as shown in FIGS. 12 and 13.

Although as shown in FIG. 6, the converging blending conduits provide only limited support to the blocking accumulation of the particulate material, in FIG. 11 the major part of the mass of particulate material is supported by the converging matrix of conduits. In FIGS. 12 and 13, the entire mass of particulate material is supported by the converging matrix of blending conduits and the vertical tubular element 1240.

Thus a very useful blender can be constructed which can be installed in silos at a much lower cost than blenders that rely solely on separate blend chambers as shown in FIG. 1, and at lower cost than the alternate embodiment fully disclose, in application Ser. No. 07/683,320, now U.S. Pat. No. 5,123,749.

BRIEF DESCRIPTION OF THE DRAWINGS

FIG. 3 provides a schematic diagram of the hopper, piping and pumps, if required for extremely uniform blending within the gravity blender of the present invention;

FIG. 4 provides a sectional view from the vertical centerline through the exterior wall of the lower portion of the hopper of an alternate embodiment of the present invention, including a detail of a blending tube and a conduit for exhaust gases, or for structural purposes;

FIG. 5 is a section of the conduit of FIG. 4, illustrating the knife-like device for preventing accumulation of particulate matter on the top surface of the conduit;

DESCRIPTION OF PRESENTLY PREFERRED EMBODIMENT OF THE INVENTION

In providing a more detailed discussion of the presently preferred embodiment of the invention, reference will be first made to components of the blending apparatus from the prior art, insofar as they differ from, or combine with, the new invention for improved and more efficient performance at lower cost.

Figure 1:
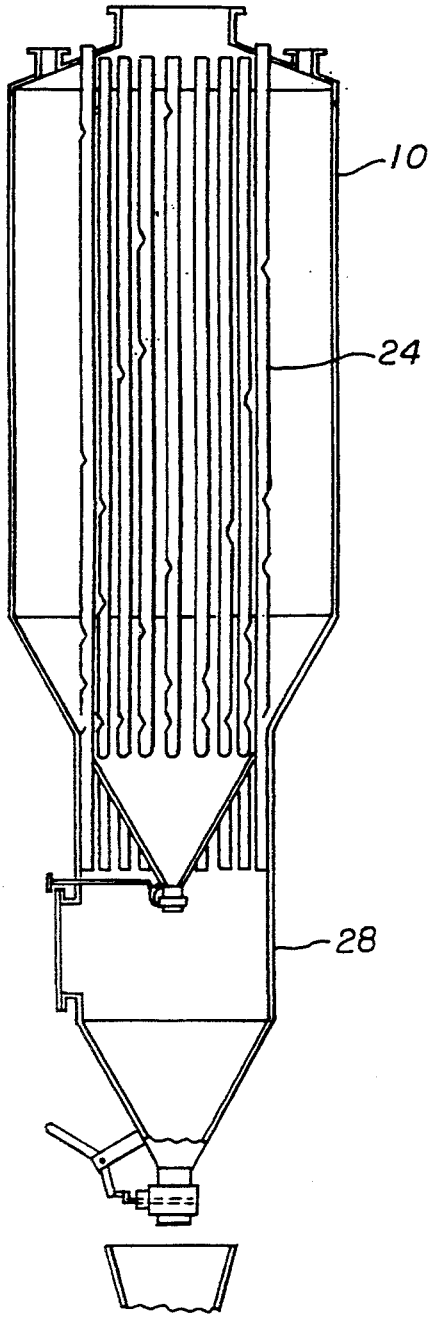
FIG.1 (PRIOR ART)
FIG. 1 provides an elevational, sectional view through the center line of a typical blender of the prior art.

In FIG. 1 is shown a drawing from U.S. Pat. No. 3,268,215, issued to T. A. Burton for a Blending Apparatus on Aug. 23, 1966. Illustrative of this prior art are tank or hopper 10, blending tubes 24, and separate receiver or collector manifold 28.

The recirculating schemes of the prior art are shown in FIG. 3, diagrams 302 and 303.

Figure 2:
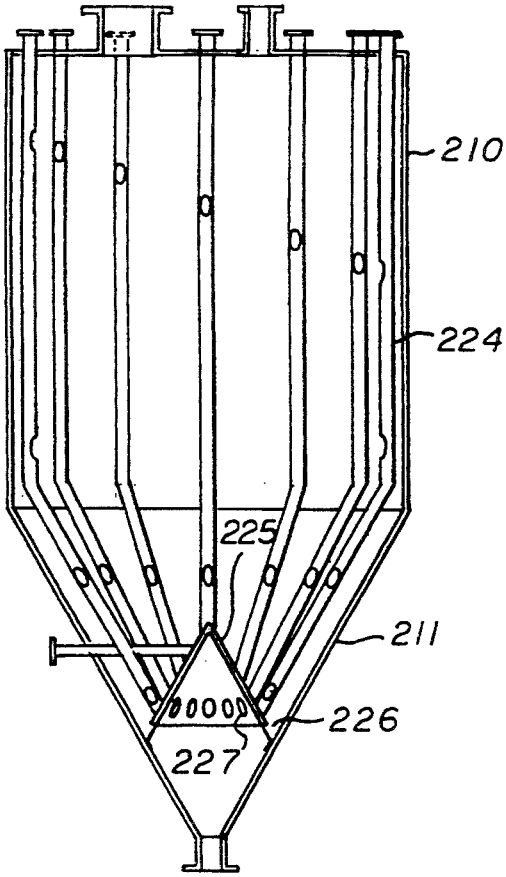
FIG. 2 provides an elevational, sectional view through the center line of an alternate embodiment of the gravity blender of the present invention.

My invention, as shown in its alternate embodiments, deals with the problem in novel fashion. In FIG. 2, and as more easily seen in FIG. 6, the blending tubes, of which tube 602 is an example, terminate in apertures 603. These apertures are formed in the convex surface 604. This means of termination is a significant departure from the prior art, as shown in FIG. 1, in which tubes 24 pass entirely through the hopper 10 and terminate in receiver 28.

Figure 9:
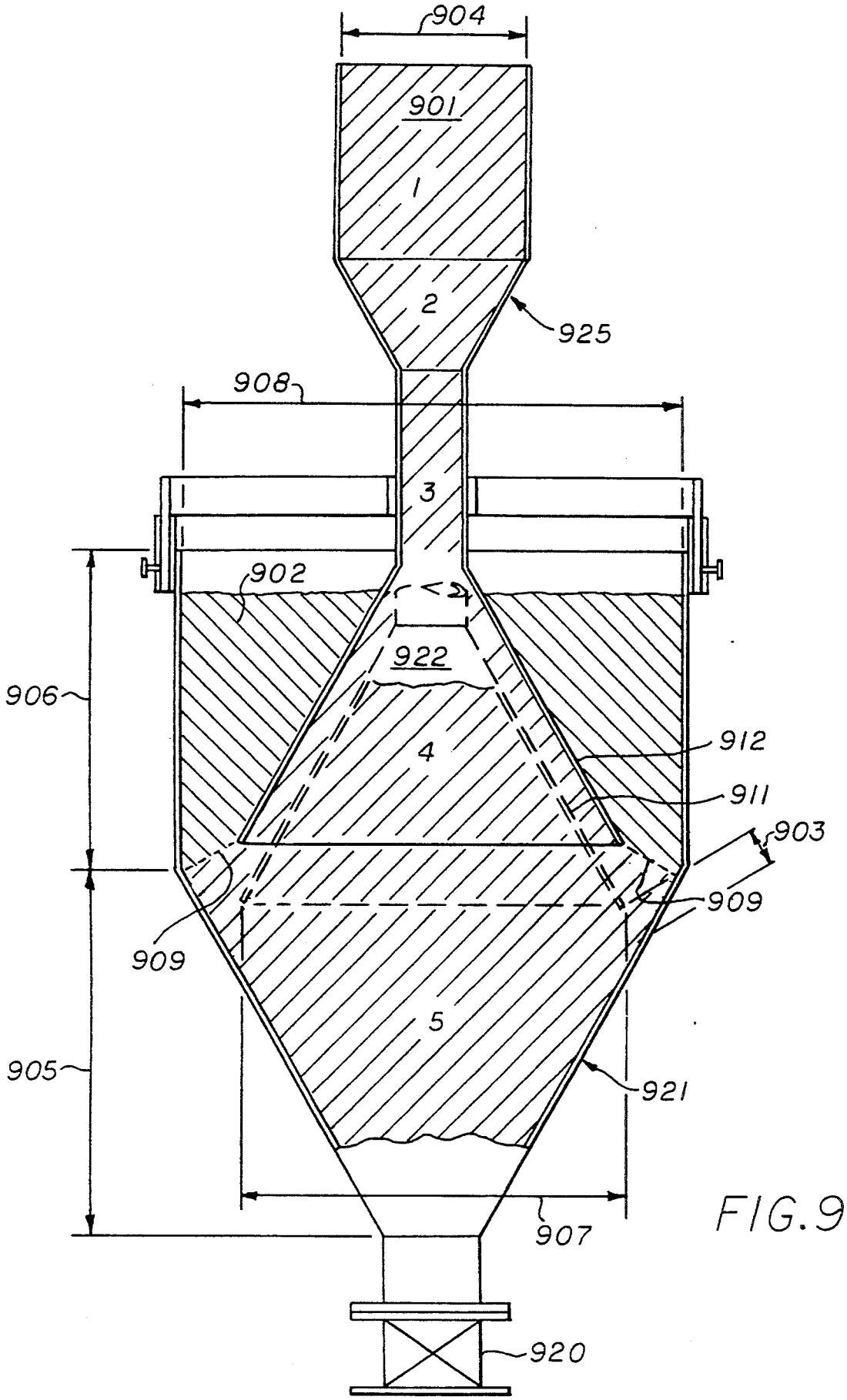
FIG. 9 provides a vertical, sectional view through the center line of the test apparatus, which substantially duplicates the conditions within, and operations of blending of an alternate embodiment of the present invention now the subject of a Divisional Application of of Ser. No. 683,320.
Figure 10:
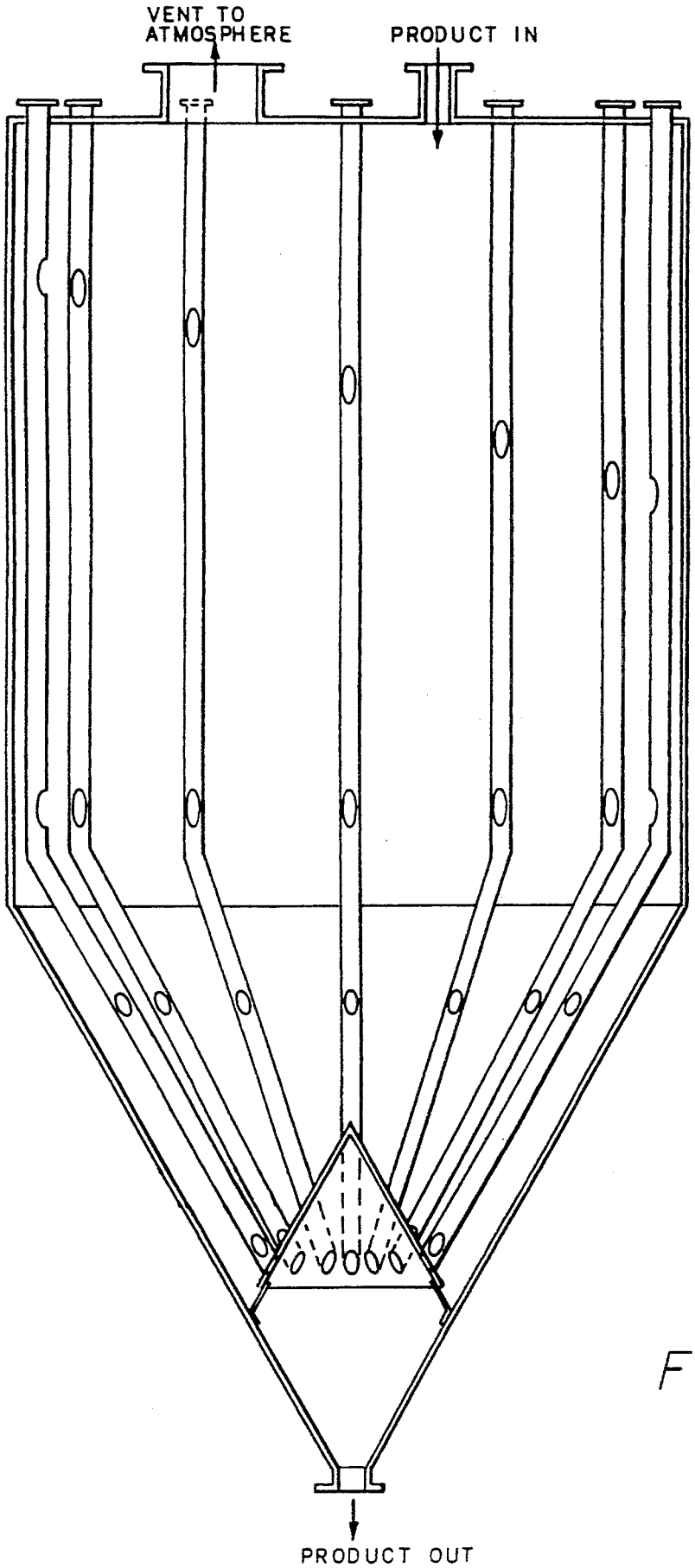
FIG. 10 provides a sectional view from the vertical centerline through the exterior wall of the lower portion of the hopper of an alternate embodiment of the present invention, including a detail of a blending tube, but without a venting conduit for exhaust gases.

Returning to FIG. 6, it should be noted that convex surface 604 is supported upon brackets 606, and is thus spaced away from the exterior cone 610 by an annular gap shown as 605. Now, if the surfaces 604, annular gaps 605, and apertures 603, are designed as will be shown in connection with the description of FIG. 9, the material to be blended will begin to fill the hopper 601, but will form a barrier at the annulus 605, past which barrier the particulate material will not descend.

In the parent application, as the blending operation being performed on the batch, or mixture, draws to a close, the level of the material will fall below the seam line 607, and then past a series of apertures 608. The discharge of material from the blender will then flow preferentially from the blending tubes 602, with essentially zero flow through the annulus 605 between the inverted cone and the vessel cone. Flow through this annulus 605 cannot occur until the supply of material coming from the blend tubes 602 is exhausted.

Figure 11:
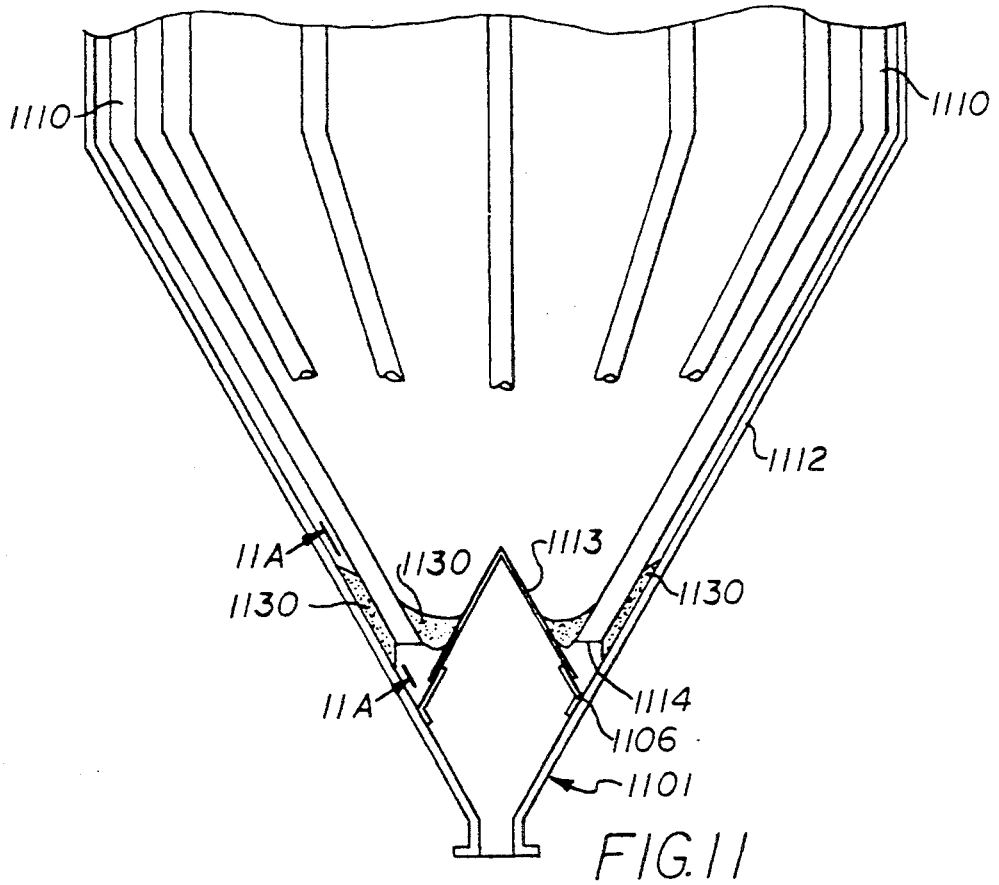
FIG. 11 provides a fragmented elevational hemicylindrical inside view, through a section in the plane including the vertical centerline of a blender, utilizing a virtual baffle of particulate material, supported partially on a matrix of converging blending tubes, and equipped with a small inverted cone. Two partial sectional details are provided.

FIG. 11, added in this application, illustrates the use of an inverted baffle through which the blending tubes 1110 do not penetrate, but which is positioned in such a manner that a voussoir of particulate material is formed between converging surfaces in close proximity to each other. In this blender, particulate material is entrapped within the matrix of conduits 1110 and small inverted cone 1113 mounted on brackets 1106 within the cone of the outer wall 1112. The density, particle shape, compactability, and a host of indeterminate factors will cooperate to establish a toroidal block of material 1130, thus creating a virtual baffle of particulate material, supported partially on a matrix of converging blending tubes 1110, a small inverted cone 1113, and lower section wall 1112. It must be understood that this drawing is purely illustrative of the inventive concept, and that other variations are within the scope of the following claims.

Figure 12:
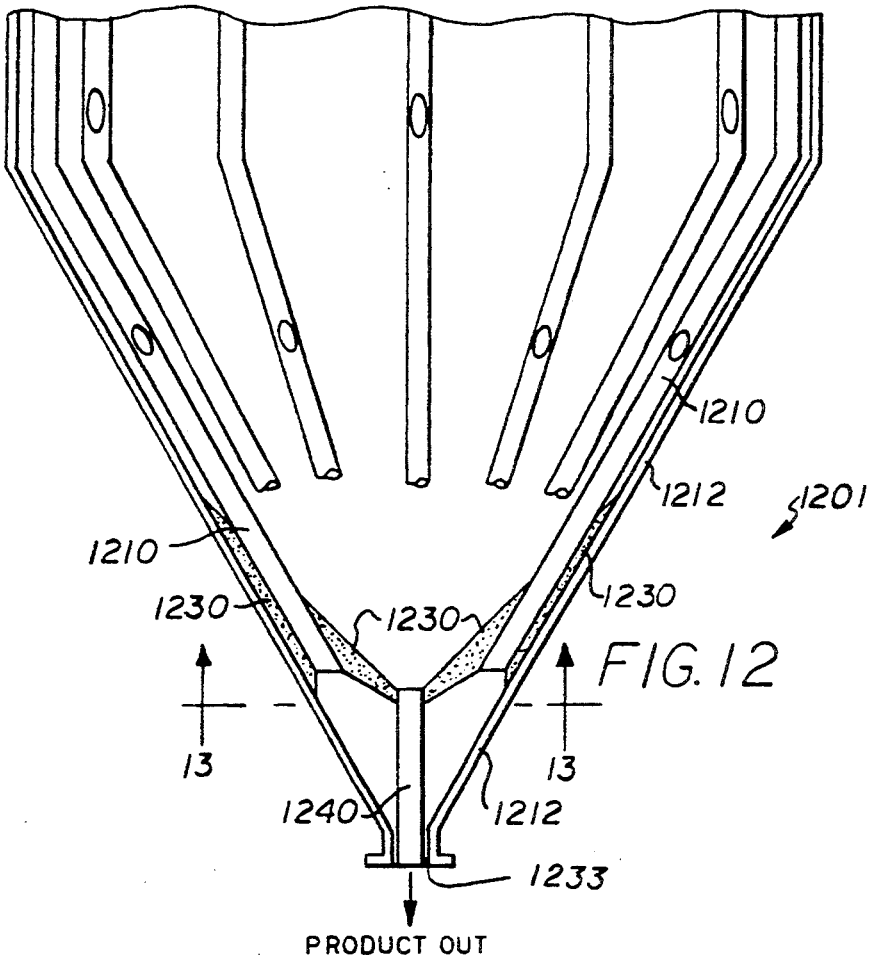
FIG. 12 provides an elevational hemicylindrical inside view, through a section in the plane including the vertical centerline of a blender, utilizing a virtual baffle of particulate material, supported solely on a matrix of converging blending tubes, without an inverted cone, but with a vertical tubular element.

FIG. 12, added in this application, illustrates the accumulation of particulate material 1230 in this blender, when entrapped within the matrix of conduits 1210, and within the cone of the outer wall 1212. This embodiment is not equipped with an inverted cone 1113, but has instead a vertical tubular element 1240. The purpose of tubular element 1240 is to assure that a voussoir of particulate material 1230 will be formed, creating a virtual baffle of particulate material, in tile form of a toroidal block, between and among the structural members, including the central tubular structure 1240. The diameter of the tube 1240 is drawn too large in comparison with the area 1233 provided for discharge of the particulate material, but the concept is adequately presented.

The density, particle shape, compactability, and a host of indeterminate factors will cooperate to establish the position, volume, and mass of material 1230. These parameters will be those required to obtain a suitable toroidal block, utilizing a virtual baffle of particulate material, supported partially on a matrix of converging blending tubes 1210 and vertical tubular element 1240. It must be understood that this drawing is purely illustrative of the inventive concept, and that other variations are within the scope the following claims.

Figure 13:
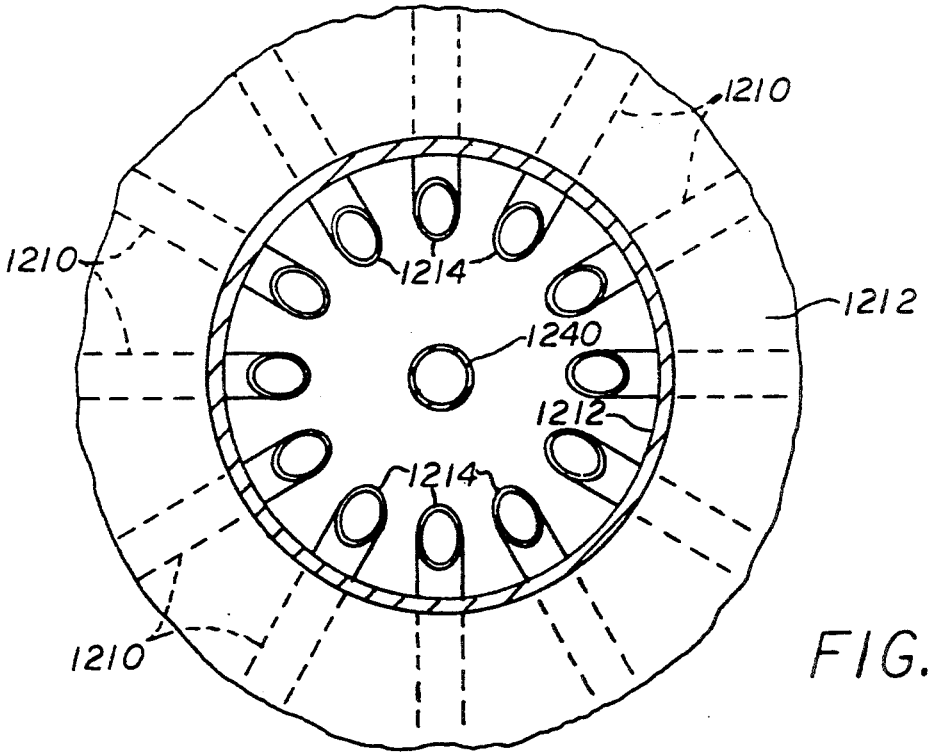
FIG. 13 provides a generally horizontal sectional view through the blender of FIG. 12, at approximately the level of the virtual baffle of particulate material, supported partially on a matrix of converging blending tube and the vertical tubular element 1240.

FIG. 13 provides a horizontal sectional view through the blender of FIG. 12, at approximately the level of the virtual baffle 1230 of particulate material, supported partially on a matrix of converging blending tubes 1210. Further support is provided by the vertical tubular structure 1240.

CLARIFICATION OF DIFFERENCES BETWEEN BAFFLES OF PRIOR APPLICATION AND PRESENTLY PREFERRED EMBODIMENT OF THE INVENTION

Figure 7:
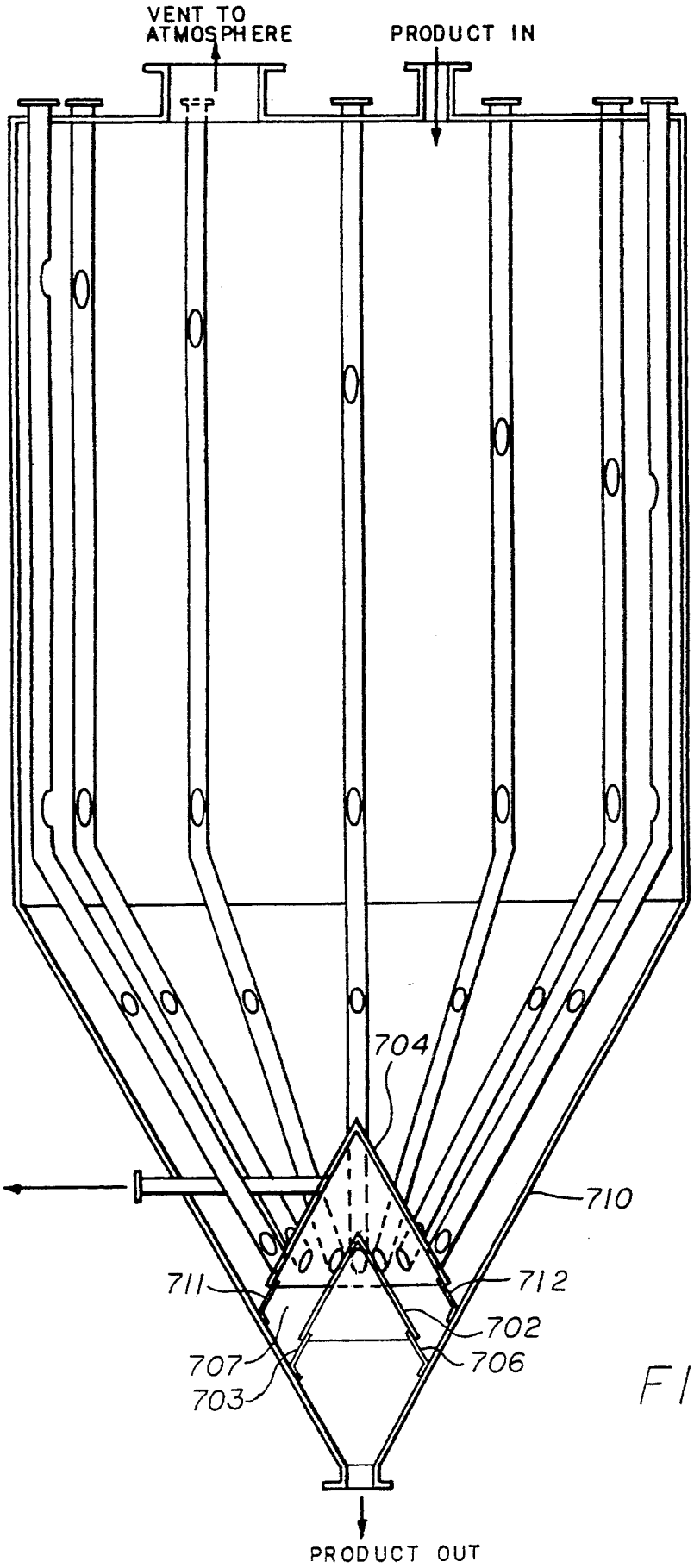
FIG. 7 is a more detailed view of an alternate embodiment of the present invention as combined with two convex surfaces for better blending of virtually all of the material to be blended.
Figure 8:
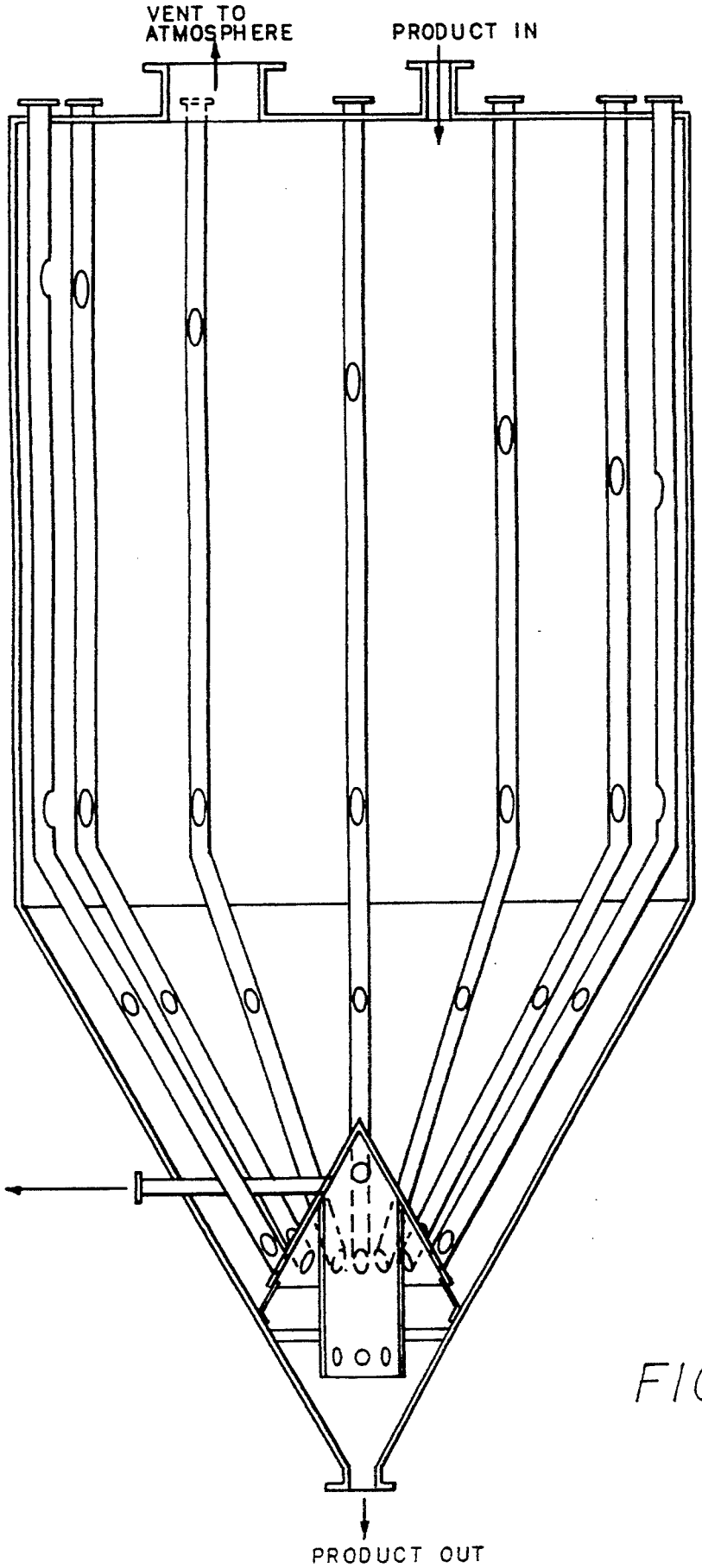
FIG. 8 provides an elevational, sectional view through the center line of a gravity blender of an alternate embodiment of the present invention, in which one basic convex surface is combined with a cylindrical device, developed further in FIG. 1213, for further improved blending.

FIG. 11 illustrates an alternate embodiment and a more economical method of construction than that of FIG. 7, achieved by eliminating the large baffle 704, and the "hard" terminations of the blending tubes in apertures in the sides of cone 704.

The matrix of converging downcoming blending tubes 1110 are mounted close to the conical wall 1112. Blending tubes 1110 do not terminate in apertures or hubs in the surface of cone 1113, but terminate in the approximate region delineated as 1114, which has a variable vertical range as shown by the two-headed arrow at 1123.

The base line of the lower end of cone 1113 may vary above or below a typical position 1114, as shown by bidirectional arrow 1123. If proper proportions are selected, such a grid of blending tubes converging toward plane 1114, in combination with the converging wall 1112 of the lower bin section 1101, can support a voussoir 1130 of particulate material, extending slightly downward or upward from reference plane 1114.

Figure 6:
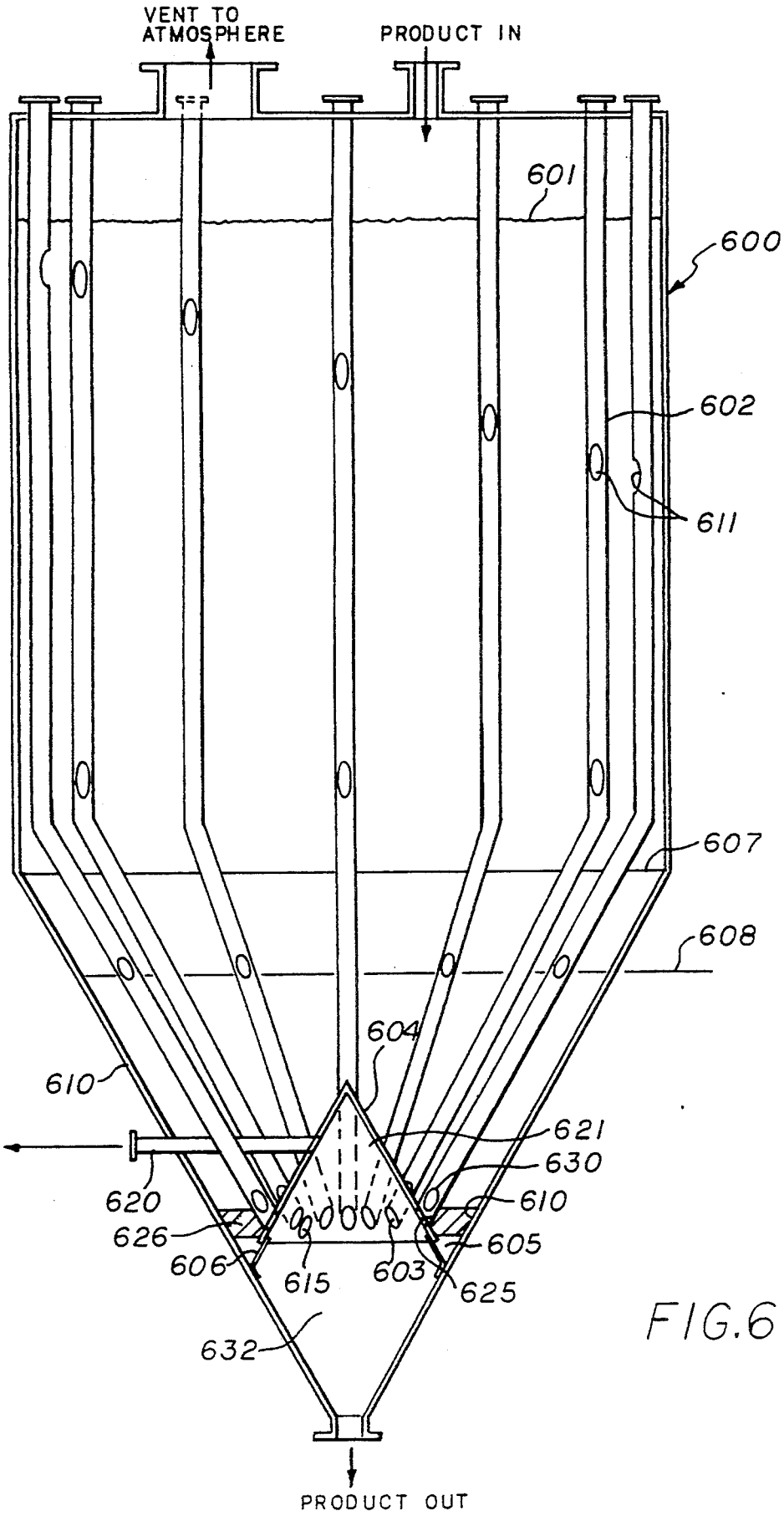
FIG. 6 is a more detailed view of an alternate embodiment of the present invention, as combined with terminations of the conventional blending tubes.

It is thus possible to achieve the blocking effect of the impervious baffle 604 of FIG. 6 without the expense of physically connecting (measuring, cutting and welding) the blending tubes to apertures in the surface of a large baffle, and in some cases the small baffle 1113 may not be needed. Please refer to FIG. 12.

Figure 11A:
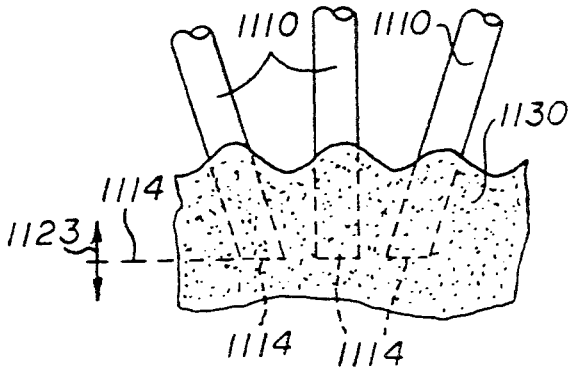
FIG. 11A is a fragmentary section just inside the wall 1112, showing the ends 1114 of the blending tubes 1110 within the toroidal block 1130 of particulate material.
Figure 11B:
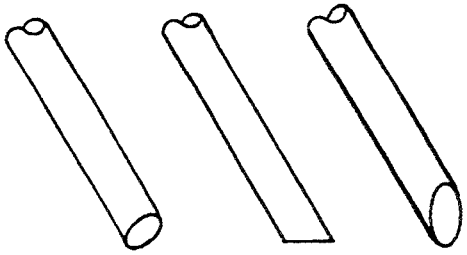
FIG. 11B shows various angles of cut off of the discharge ends 1114 of the blending tubes 1110.

In FIG. 11A, various terminations for the blending tubes may be employed. The intent of this disclosure is to illustrate the concept of a baffle primarily of particulate material, simpler to build and less costly in material. The specific terminations of blending conduits, patterns of the matrix, and use or nonuse of small convex cones are all minor variations contemplated in the general use of this invention.

In FIG. 12 is shown an embodiment which does not use the small inverted baffle or cone 1113, a preferred construction being the structural tubing 1240. With some particulate materials, the conical wall 1112 in combination with the blending tube matrix 1110, may support the toroidal blocking mass of material 1120 without member 1240.

The section shown in FIG. 13 is typical of many usable designs. The intent of this disclosure is to illustrate the concept of a baffle primarily of particulate material, simpler to build and less costly in material. The specific terminations of blending conduits, patterns of the matrix, and use or nonuse of small convex cones are all minor variations contemplated in the general use of this invention.

What is claimed is:

1. A gravity blender apparatus having an upper portion and a lower portion, both portions centered on a single vertical axis, the blender comprising:

(a) the upper portion, defining a generally cylindrical bin means operable to receive and store a mass of particulate material;

(b) the lower portion, defining a downwardly converging conical section sealed to the lower cylindrical edge of the upper portion;

(c) a plurality of blending conduits extending downward from the upper portion of said bin means, said conduits mounted internally and vertically within said upper portion, said blending conduits continuing downwardly adjacent said converging conical section, said blending conduits converging downwardly toward said vertical axis of said blender said conduits each having a lower open end, terminating in a generally circular and horizontal pattern;

(d) an upwardly converging conical surface, having a maximum diameter substantially that of the diameter of the circular pattern of said lower open ends of said conduits, the conical surface projecting upward toward said circle of said open conduit lower ends, said conduits being spaced above a bottom of said conical surface;

said convergence of said blending conduits, said conical walls of said lower section and said conical surface projecting upward, creating and supporting in operation a virtual baffle of particulate material, in combination, said baffle consisting of voussoir-like accumulations of particulate material in said converging channels between said conduits and between said conical walls and said conduits;

said voussoir-like accumulations serving additionally as the base of a virtual baffle, said virtual baffle being formed solely of said particulate material supported upon a matrix of said converging blending conduits, said conical lower portion of said bin walls, and said conical surface projecting upward toward said circle of said open conduit ends;

said blending conduits operable to convey particulate material from regions of said blender above a top of said virtual baffle to discharge from said blender; and said baffle of particulate material remaining in position until said blending tubes have begun to release said final portions of said particulate material through said blending tubes to blend with said particulate material of said virtual baffle as both pass through said lower portion of said bin.

* * * * *